United States Patent [19]

Ohira et al.

[11] 4,150,734

[45] Apr. 24, 1979

[54] ELEVATOR CONTROL APPARATUS

[75] Inventors: Takeshi Ohira, Katsuta; Tadao Kameyama, Higashiibaraki; Chihiko Honzyo, Katsuta; Yuzaburo Iwasa, Hitachi; Takanobu Hatakeyama, Katsuta, all of Japan

[73] Assignee: Hitachi, Ltd., Japan

[21] Appl. No.: 871,801

[22] Filed: Jan. 24, 1978

[51] Int. Cl.[2] ..... B66B 1/30

[52] U.S. Cl. ..... 187/29 R

[58] Field of Search ..... 187/29; 318/327, 328, 318/618

[56] References Cited

U.S. PATENT DOCUMENTS

| | | | |
|---|---|---|---|
| 3,090,901 | 5/1963 | Shaw | 318/328 X |
| 3,250,975 | 5/1966 | Pepper | 318/328 X |
| 3,531,704 | 9/1970 | Uemura et al. | 318/328 |
| 3,728,565 | 4/1973 | O'Callaghan | 318/618 X |
| 3,764,888 | 10/1973 | Anderson | 318/328 X |
| 3,774,729 | 11/1973 | Winkler | 187/29 |
| 4,024,445 | 5/1977 | Tokuda et al. | 318/328 X |
| 4,046,229 | 9/1977 | Kernick et al. | 187/29 |
| 4,083,431 | 4/1978 | Oohira et al. | 187/29 |
| 4,084,662 | 4/1978 | Tezuka et al. | 187/29 |

*Primary Examiner*—Gene Z. Rubinson
*Assistant Examiner*—W. E. Duncanson, Jr.
*Attorney, Agent, or Firm*—Craig & Antonelli

[57] ABSTRACT

An elevator car control apparatus is disclosed in which a three-phase AC tachometer generator is coupled to a motor for driving an elevator car, and the AC output of the tachometer generator is full-wave rectified for use as a speed feedback voltage. A waveform-shaping circuit generates one pulse for each cycle of the output of the AC tachometer generator. A counter counts such pulses after the car has passed a deceleration-initiating point, thereby producing the number of counts proportional to a car running distance after the passage of the deceleration-initiating point. From this number of counts, a deceleration command voltage decreasing progressively in accordance with car positions is obtained by a decoder and a digital-analog converter. During deceleration, the car-drive motor is subjected to feedback control in accordance with the difference between the speed feedback voltage and the deceleration command voltage, thus effecting deceleration control of the elevator car.

15 Claims, 8 Drawing Figures

ELEVATOR CONTROL APPARATUS

This invention relates to an elevator control apparatus effecting speed feedback control.

Generally, the control of an elevator car is effected by controlling the speed of a car-drive motor in accordance with a speed command signal and a speed feedback signal. In order to assure the riding comfort and accurate floor landing, the speed command signal is required to be exactly matched with a car position, especially during car deceleration. Thus, car speed control with high accuracy requires accurate detection of car positions and speeds. Conventionally, four methods are considered for detecting car positions and speeds.

A first method uses a floor selector and a DC tachometer generator. As well known, the floor selector includes a movable section adapted to move in a reduced scale in proportion to actual car motion, whereby the car position is detected indirectly. The car speed is detected by an output voltage of the DC tachometer generator coupled to the car drive motor. This method, due to this high accuracy and reliability in position and speed detection, is now used most widely. The disadvantages are, however, a very complicated configuration, a high cost and the necessity of maintenance and inspection of the floor selector and the DC tachometer generator as often as about once every month.

A second method uses a pulse generator and a DC tachometer generator. The pulse generator is operated in synchronism with car travel and the output pulses thereof are counted, thereby detecting the car position. The car speed is detected in the same manner as in the first method. The method under consideration, unlike the first one, eliminates the need of a floor selector and therefore is somewhat more economical but still high in cost and requires substantially the same maintenance and inspection as the first method.

A third method uses only a DC tachometer generator for detection purpose without using the floor selector or pulse generator, which is disclosed for example in Japanese Patent Publication No. 40219/73. The DC tachometer generator is coupled to a car drive motor, the output voltage of which is continuously integrated. The value of the integration is proportional to the car running distance. The integrated result is thus used to detect the car position, while the car speed is detected by the output voltage of the DC tachometer generator similarly to the preceding method. However, it is impossible to accurately integrate the output of the DC tachometer generator over a long period of time, which results in a low position-detecting accuracy, and hence the method under consideration is not suitable for a practical application.

According to a fourth method, a multiplicity of proximity switches are used to directly detect the car position, while the car speed is detected by a DC tachometer generator. The proximity switches are mounted on the hoistway wall. The car position is detected by the proximity switches actuated by an object to be detected, which is mounted on the car body. A great number of proximity switches are required to attain high accuracy of car position detection. To overcome this shortcoming, in an alternative now widely used, objects to be detected are mounted on the hoistway wall at the deceleration-initiating points for respective floors, and a plurality of proximity switches located on the car detect with high accuracy the car position only after the car has passed the deceleration-initiating point. Such an alternative method is disclosed for example in U.S. Pat. No. 3,876,918. This method is low in cost and practically usable as compared with the first and second methods. However, since the proximity switches are mounted on the car, it is necessary to provide on the car a proximity-switch-mounting bar having the same length as a required car deceleration distance. The length of the switch-mounting bar is structurally limited generally to about one meter. This method, therefore, is applicable only to an elevator system with the car deceleration distance of one meter or less, which generally involves a car speed of 60 m/min or lower. For the elevator systems involving a car speed higher than that, the use of the first or second method is unavoidable. Further, even in the alternative method, a great number of proximity switches are required if the car position after passing the deceleration-initiating point is to be detected accurately. This results in a very high cost and a lower reliability, and also makes maintenance and inspection difficult.

An object of the present invention is to provide a highly economic elevator control apparatus having a simple construction in which the car speed is controlled in accordance with a car speed feedback signal and a speed command signal corresponding to the car position.

According to the present invention, there is provided an elevator control apparatus including a motor for driving a car running in an elevator hoistway, a device for generating a speed command signal in accordance with the position of said car, and a device for controlling said motor in response to said speed command signal and a feedback signal of the speed of said motor; the elevator control apparatus further comprising an AC tachometer generator driven by said car drive motor, a rectifier circuit for rectifying the output of the AC tachometer generator to deliver the speed feedback signal, and a counter for detecting a car position by counting the number proportional to the output frequency of said AC tachometer generator.

The other objects and features of the present invention will explained with reference to the accompanying drawings in which.

A control apparatus for a three-phase induction motor is proposed in U.S. Pat. No 3,805,133. This apparatus in suitable in the case where an elevator car is controlled continuously from powering operation to deceleration operation. Embodiments of the present invention will be explained below with reference to the case where the present invention is applied to an elevator control apparatus using the motor control apparatus disclosed in the U.S. Pat. No. 3,805,133. In order to improve the riding comfort and floor-landing accuracy of the car, detection of car position after initiation of deceleration is important. In the embodiments undermentioned, therefore, an explanation will be made in detail especially of a device most suitable for detecting the car position after initiation of deceleration and a device for generating a car deceleration commond in accordance with the detected car position.

Figure 1:
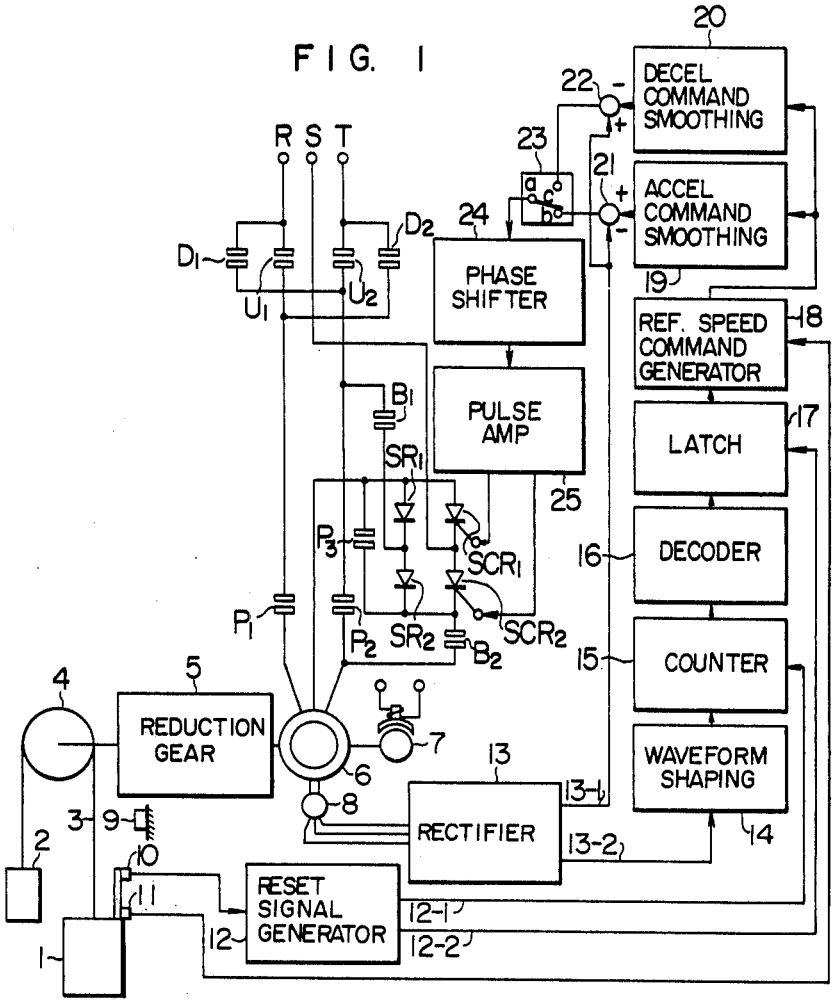
FIG. 1 is a block diagram showing the general construction of an elevator control apparatus according to the present invention.

A block diagram for explaining the general construction of the control apparatus according to the present invention is shown in FIG. 1, each section of which will be described in detail later.

An elevator car 1 and a counter-weight 2 are hung on a sheave 4 by means of a rope 3. The sheave 4 is connected through a reduction gear 5 to an elevator car-drive three-phase induction motor 6 and an electromagnetic brake 7. The induction motor 6 is in turn coupled to a three-phase AC tachometer generator 8. Reference characters R, S and T show a three-phase AC power supply, characters $U_1$ and $U_2$ contactors adapted to close during upward travel of the car, characters $D_1$ and $D_2$ contactors adapted to close during downward travel thereof. During the powering control of the car, contactors $P_1$, $P_2$ $P_3$ are closed and the contactors $U_1$ and $U_2$ or $D_1$ and $D_2$ are closed in accordance with the direction of car travel. As a result, the DC output terminals of a mixed bridge circuit comprising thyristors $SCR_1$ and $SCR_2$ and rectifiers $SR_1$ and $SR_2$ are shorted by the contactor $P_3$, so that the thyristors $SCR_1$ and $SCR_2$ connected in reverse parallel are inserted between the S phase of the power supply and the terminal of one of the primary windings of the induction motor 6.

The remaining two terminals of the primary windings of the induction motor, on the other hand, are directly connected to the power supply terminals R and T respectively, thus making up a circuit configuration for powering operation.

At the same time, a device described later causes a well-known elevator car start to be applied to a reference speed command generator circuit 18, the output of which in turn is applied to an acceleration command smoothing circuit 19. An acceleration command signal and a speed feedback signal, i.e., an output signal at a terminal 13-1, which is the result of rectifying the output of the AC tachometer generator 8 coupled to the induction motor 6, by a rectifier circuit 13, are applied to a comparator circuit 21 for powering control. Since the contact of a switching circuit 23 is closed on side b, the difference between the acceleration command signal and the speed feedback signal detected by the comparator circuit 21 is aplied to a phase shifter circuit 24. The output of the phase shifter circuit 24 is amplified to a predetermined magnitude by a pulse amplifier circuit 25. This signal is applied as a gate signal to the thyristors $SCR_1$ and $SCR_2$ for firing control. Thus, the generated torque of the induction motor 6 is regulated continuously from the single-phase torque to the maximum torque by control of primary single-phase voltage of the induction motor 6, thereby effecting powering control.

When the car in the accelerated condition runs at the rated speed and reaches a deceleration-initiating point, a deceleration-initiating point detector 10 including a proximity switch mounted on the car, detects the deceleration-initiating point in cooperation with a detector unit 9 arranged on the hoistway. The resulting deceleration-initiating point detection signal opens the contactors $P_1$, $P_2$ and $P_3$, and closes contactors $B_1$ and $B_2$. The DC output terminals of the mixed bridge comprising the thyristors $SCR_1$, $SCR_2$ and the rectifiers $SR_1$, $SR_2$ are released from the shorted condition, and the AC terminals of the bridge are connected to S and T phases of the power supply, while the DC terminals thereof are connected to the two terminals of the primary windings of the induction motor 6. This process makes up a DC brake circuit which is a main circuit for deceleration control. At the same time, the contact of the switching circuit 23 is closed on side c. Under this condition, the output at a given terminal (such as a terminal 13-2 in the embodiment of FIG. 1) of the rectifier circuit 13 for rectifying the output of the AC tachometer generator 8 into a direct current is shaped into a pulse form by a waveform shaping circuit 14. The signal thus shaped is applied to a counter circuit 15, a decoder circuit 16 and a latch circuit 17, thereby detecting the car position. In other words, the signal from the deceleration-initiating position detector 10 is applied to a reset signal generator circuit 12 for the latch circuit 17 and the counter circuit 15, and the output signals at the terminals 12-1 and 12-2 are used to set the counter circuit 15 and the latch circuit 17. Output pulses of the waveform-shaping circuit 14 proportional to the number of revolutions of the induction motor are counted by the counter circuit 15, the output of which is applied to the decoder circuit 16 and stored in the latch circuit 17 to detect the car position after initiation of deceleration. The resulting position signal is applied to the reference speed command generator circuit 18 thereby to produce a signal stepwisely decreasing in accordance with the position of the car under deceleration. This stepped signal is formed into a smoothly decreasing deceleration command signal by a deceleration command smoothing circuit 20.

The deceleration command signal thus produced and the speed feedback signal are applied to a comparator circuit 22 for deceleration control, thereby detecting the difference between the speed feedback signal and the deceleration command signal. This difference is applied to the gates of the thyristors $SCR_1$ and $SCR_2$ through the phase shifter circuit 24 and the pulse amplifier circuit 25, so that the firing phase of the thyristors is controlled, and thus the DC brake force of the induction motor 6 is controlled, whereby the deceleration control of the car is effected.

When the car decelerates and reaches a predetermined point before a target landing floor, a deceleration end point detector 11 detects a deceleration end position, and the output signal of the detector 11 is used to cut off the power supply to the reference speed command signal generator circuit 18, thereby reducing the deceleration command signal to zero. When a well-known device detects that the car speed has been reduced to zero, the contactors $U_1$ and $U_2$ (or $D_1$ and $D_2$) and $B_1$ and $B_2$ are opened by its output signal with the result that the electromagnetic brake 7 is actuated, thus stopping and holding the car stationary.

Upon stoppage of the car, a reset signal is applied from the reset signal generator circuit 12 to the counter circuit 15 and the latch circuit 17, so that the counter circuit 15 and the latch circuit 17 are reset and rendered ready for the next operation.

Figure 2:
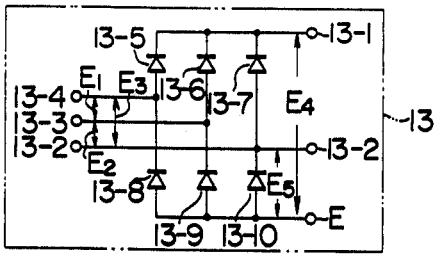
FIG. 2 shows a specific structure of a three-phase full-wave rectifier circuit.

A concrete circuit diagram of the rectifier circuit 13 for detecting the speed feedback signal proportional to the number of revolutions of the induction motor 6 and the frequency thereof is shown in FIG. 2. Voltage waveforms for explaining the operation of the circuit 13 are shown in FIG. 3.

Figure 3:
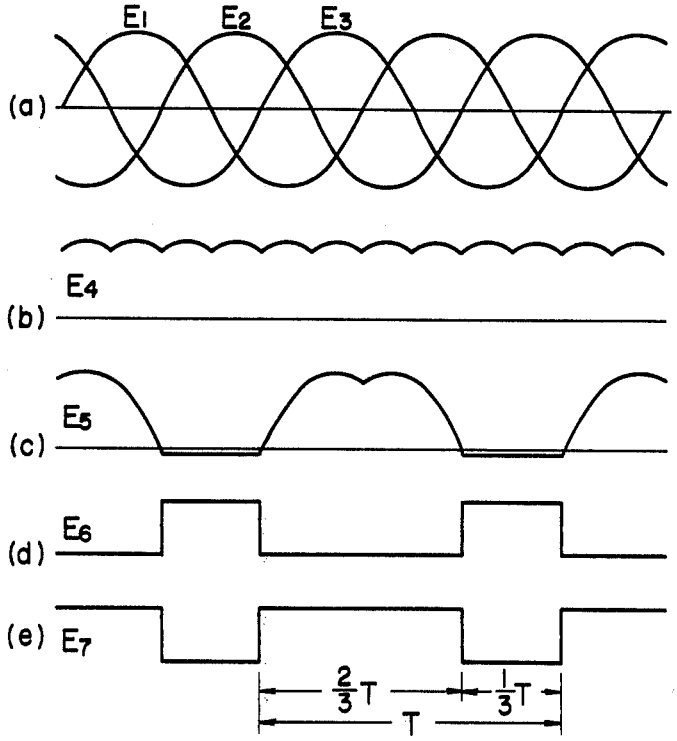
FIG. 3 shows voltage waveforms for explaining the operation of the circuits of FIGS. 2 and 4.

The outputs $E_1$, $E_2$ and $E_3$ of the three-phase AC tachometer generator 8 are, as shown in (a) of FIG. 3, three-phase AC voltage components having a phase difference of $\frac{1}{3}\cdot T$ with each other, where T represents period of $E_1$, $E_2$ and $E_3$. The magnitude and phase of the voltages $E_1$, $E_2$ and $E_3$ are varied in proportion to the number of revolutions of the induction motor 6.

By applying these voltages to the input terminals 13-2, 13-3 and 13-4 of the three-phase full-wave rectifier circuit 13 comprised of six rectifiers 13-5 to 13-10, a DC output voltage $E_4$ having a waveform as shown in (b) of FIG. 3 is produced. The magnitude of this DC voltage $E_4$ is proportional to the car speed and it is used as a speed feedback signal. In this case, the smaller the ripple included in the speed feedback signal $E_4$, the better the elevator car control characteristics. For this reason, the AC tachometer generator 8 is preferably of three-phase type with many poles.

The pulses proportional to the number of revolutions of the induction motor 6 are detected in the manner mentioned below.

A voltage $E_5$ between earth E and a given AC terminal, say, the terminal 13-2 of the three-phase full-wave rectifier circuit 13 in FIG. 2 is taken out. The voltage $E_5$ is positive only when the potential at the terminal 13-2 is higher than that at terminal 13-3 or 13-4. In the case where the potential at terminal 13-2 is lower than that at terminal 13-3 or 13-4, on the other hand, the voltage $E_5$ becomes negative with respect to the forward voltage drop at the rectifier 13-10. Accordingly, as shown in (c) of FIG. 3, an asymmetric AC voltage with $\frac{2}{3}\cdot T$ and $\frac{1}{3}\cdot T$ on positive and negative sides respectively is obtained. Since a signal proportional to the number of revolutions of the induction motor 6 is taken out of one arm of the rectifier circuit 13 in this way, the need of an additional circuit is eliminated.

Figure 4:
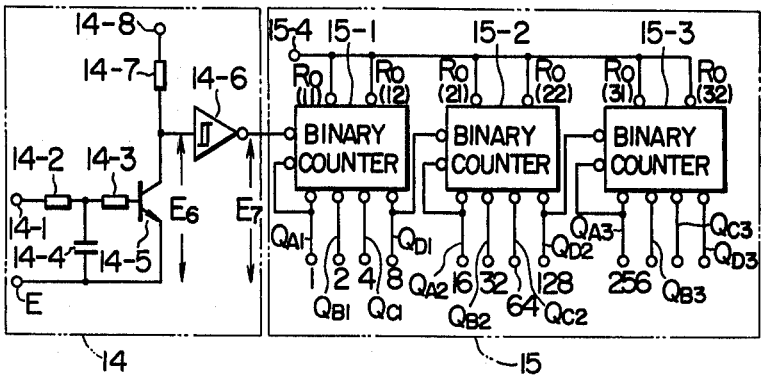
FIG. 4 is a diagram showing a specific structure of a waveform-shaping circuit and a counter circuit.

The voltage $E_5$ is applied between earth E and the input terminal 14-1 of the waveform-shaping circuit 14 shown in FIG. 4, and further to the base of a transistor 14-5 through a filter circuit including resistors 14-2 and 14-3 and a capacitor 14-4, so that a collector voltage $E_6$ of the transistor 14-5 is produced as shown in (d) of FIG. 3. The voltage $E_6$ is shaped by a Schmitt-type inverter 14-6 made up of integrated circuits. As output voltage $E_7$ of the inverter 14-6, as shown in (e) of FIG. 3, assumes a rectangular form having a duration of $\frac{2}{3}\cdot T$ and an interval of $\frac{1}{3}\cdot T$. Reference numerals 14-8 and 14-7 show a power supply terminal and a resistor.

The repetition frequency f ($=1/T$) of the output pulses $E_7$ is proportional to the number of revolutions of the induction motor 6. By applying these pulses to the counter circuit 15 of FIG. 4, the number of pulses of $E_7$ are counted.

The relation among the diameter D(m) of the elevator sheave 4, the reduction ratio i of the reduction gear 5, the number of revolutions N (rpm) of the induction motor 6 and the car speed v (m/s) is expressed below.

$$v=(N\pi D/i)\times 1/60 \text{ (m/s)} \quad (1)$$

The relation between the pole number P of the three-phase AC tachometer generator 8 and the frequency f (Hz) of the output voltage thereof is given as $$N=120f/P \text{ (rpm)} \quad (2)$$

From equations (1) and (2), the car running distance Sp for 1 Hz of the output voltage frequency f of the AC tachometer generator 8 is $$Sp=v/f=2\pi D/iP \text{ (m)} \quad (3)$$

This necessarily determines the deceleration rate as restricted by the riding comfort of the car and the deceleration distance required for reducing the rated speed of the car to its stoppage, which in turn determines the number of output pulses of the AC tachometer generator 8 to be counted by the counter circuit 15. Assuming that the average deceleration rate of the elevator car with the rated speed of 60 m/min is desirably 0.5 m/s$^2$ from the viewpoint of riding comfort, the deceleration distance is 1 m. Also assuming that the AC tachometer generator 8 has 48 poles, that the sheave diameter is 0.5 m, and that the reduction ratio i of the reduction gear 5 is 25.5, the car running distance for each pulse of the output of the AC tachometer generator 8 is 2.55 mm. As a result, 400 pulses are counted during the deceleration distance of 1 m. Further, the car position after passing the deceleration-initiating point is accurately detected by multiplying 2.55 mm by n, where n is the count value of the counter 15.

The embodiment under consideration is applied to the elevator system under the above-mentioned conditions.

The counter circuit 15 thus comprises three 4-bit binary counters 15-1, 15-2 and 15-3 in series, thereby making up a counter effecting count of from zero to 255. (The outputs $Q_{B3}$, $Q_{C3}$ and $Q_{D3}$ of the counter 15-3 are not used.) In order for making the counting operation of the counters 15-1, 15-2 and 15-3 to be started or prohibited simultaneously, the reset terminals $R_{O(11)}$, $R_{O(12)}$, $R_{O(21)}$, $R_{O(22)}$, $R_{O(31)}$ and $R_{O(32)}$ are connected collectively to the reset terminal 15-4 of the counter circuit 15. The reset terminal 15-4 is impressed with a signal from the reset signal generator circuit 12 shown in FIG. 1. A "0" signal, i.e., a count-start signal is generated at the deceleration-initiating point thereby to count the output pulses of the AC tachometer generator 8, while the counting is prohibited by generating a "1" signal during car stoppage. In this manner, the counting operation is prohibited except during car deceleration, thus preventing the effect of noises generated during car stoppage or powering operation.

The counting value of the counter circuit 15 is proportional to the car position after passing the deceleration-initiating point. As seen from the foregoing description, the accurate car position is detected continuously by multiplication of the car running distance per one pulse by the counting value.

The outputs $Q_{A1}$ to $Q_{A3}$ of the counter circuit 15 are applied to the decoder circuit 16 thereby to decode the car position required for producing a deceleration command. In this case, the input-output relation of the decoder circuit 16 is required to be set on the basis of the relation between car speed and deceleration distance shown in FIG. 5.

In order to attain the preferable riding comfort of the car, the car deceleration should desirably be controlled in such a manner as to be smoothly increased and decreased in the vicinity of the deceleration-initiating point and the deceleration-end point respectively, while maintaining the deceleration rate substantially constant between the deceleration initiating and end points. One method for setting deceleration positions to attain a preferable riding comfort is shown in FIG. 5, where $v_0$ shows the rated speed of the car, and $S_0$ the deceleration distance with the car landing point being zero.

Figure 5:
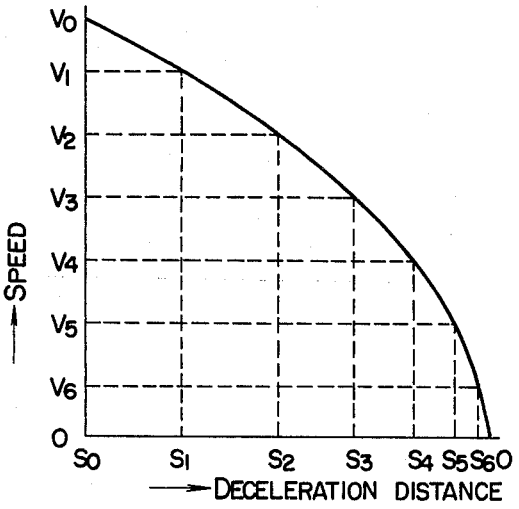
FIG. 5 is a diagram for explaining the method for setting deceleration positions.

In FIG. 5, the speed differences $V_0-V_1$ and $V_6-0$ are made small in the vicinity of the deceleration-initiating and deceleration-end points, while maintaining substantially constant the intermediate speed differences $V_1-V_2$, $V_2-V_3$, $V_3-V_4$, $V_4-V_5$ and $V_5-V_6$. Corresponding differences in distance are $S_0-S_1$, $S_1-S_2$, $S_3-S_4$, $S_4-S_5$, $S_5-S_6$ and $S_6-0$.

The number of pulses corresponding to each of the deceleration positions $S_1$ to $S_5$ thus obtained is calculated by the equation (3) thereby to set the number of pulses to be applied to the decoder. The position $S_0$ is detected by the output signal of the deceleration-initiating point detector in FIG. 1, and the position $S_6$ by the output signal of the deceleration end position detector.

Figure 6:
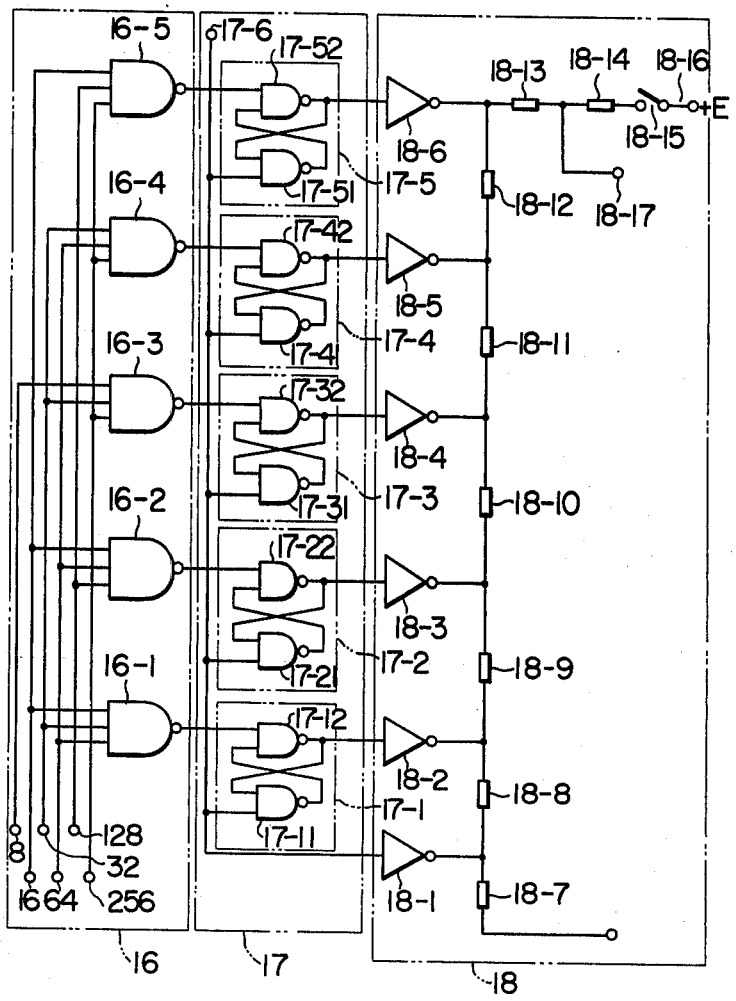
FIG. 6 is a diagram showing the construction of a circuit for producing a reference speed command voltage.

FIG. 6 shows a circuit diagram for taking out the deceleration positions $S_1$ to $S_5$ determined in accordance with FIG. 5, from the decoder circuit 16, storing the output of the decoder circuit 16 in the latch circuit 17, applying the output of the latch circuit 17 to the deceleration reference speed command generator circuit 18 including inverters with an open collector and dividing resistors, and thus producing a reference speed command voltage.

In FIG. 6, the decoder circuit 16 is made up of five three-input NAND elements 16-1 to 16-5. Assuming that the number of pulses associated with the position $S_1$ in FIG. 5 is 112, the outputs $Q_{A2}$, $Q_{B2}$ and $Q_{C2}$ of the counter circuit 15 in FIG. 4 are applied to the NAND element 16-1, which produces an output for 112 pulses $(=16+32+64)$, thereby detecting the position $S_1$.

In like manner, the number of pulses associated with each of $S_2$, $S_3$, $S_4$ and $S_5$ is set. In order to attain the number of pulses thus set, the outputs of the counter circuit in FIG. 4 are combined appropriately and applied to the NAND elements 16-2 to 16-5 for position detection.

In the embodiment under consideration, the deceleration positions $S_1$ to $S_5$ are taken out separately by the NAND elements 16-1 to 16-5 from the count made by the counter circuit 15.

An alternative method is such that the deceleration position $S_1$ is detected by the NAND element 16-1, while the deceleration position $S_2$ is detected by the NAND element 16-2 on the basis of generation of the signal from the NAND element 16-1 and the subsequent counting of pulses corresponding to $S_2$ minus $S_1$. Subsequent deceleration positions $S_3$ to $S_5$ are also detected on the basis of generation of signals by the preceding NAND elements 16-2 to 16-4. In this method, however, if a NAND element in the preceding stage fails to produce a signal due to a fault or other causes, subsequent deceleration positions cannot be detected. In the case of car control requiring a high reliability, therefore, the method shown in the drawing is more desirable.

The outputs of decorder circuit 16 are applied to the latch circuits 17-1 to 17-5 respectively made up of two NAND elements 17-11 and 17-21 to 17-51 and 17-52, in which the output of the decoder circuit 16 is stored upon application of a "1" signal to the reset terminal 17-6 of the latch circuit 17 from the reset signal generator circuit 12 in FIG. 1 at the deceleration-initiating point.

The process of generator the reference speed command voltage at an output terminal 18-17 in FIG. 6 will be explained below with reference to FIG. 7. A contact 18-15 shown in FIG. 6 is so constructed as to be kept closed during the period from car start to the deceleration end position as shown in (a) of FIG. 7, in response to the car start signal and the output signal of the deceleration end point detector 11 of FIG. 1.

Figure 7:
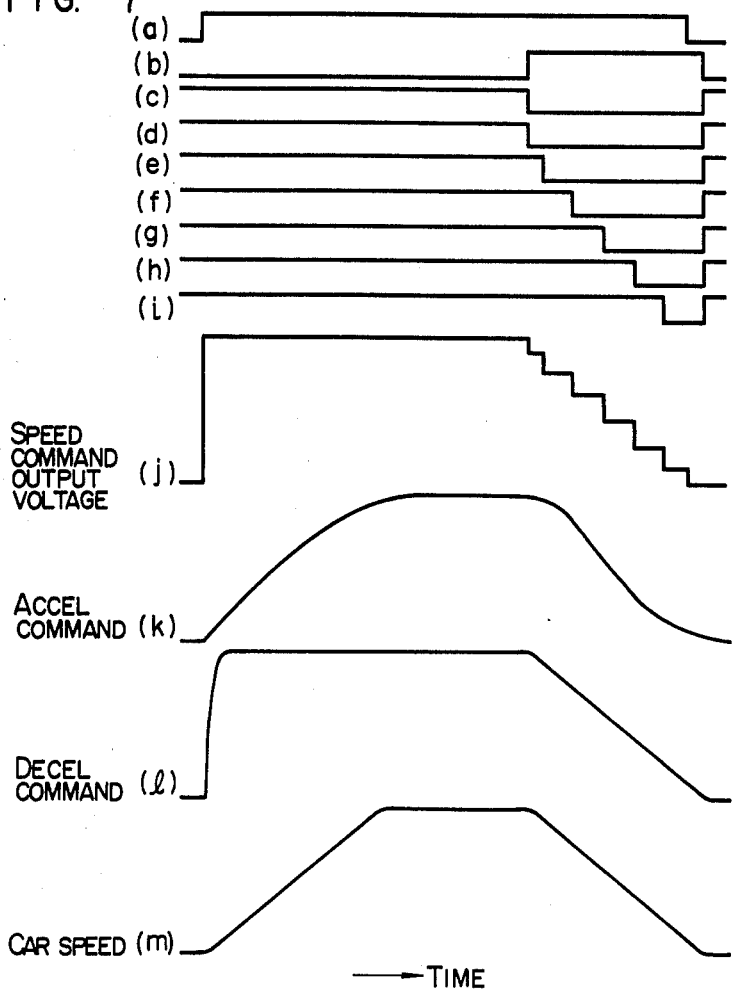
FIG. 7 shows voltage waveforms for explaining the operation of the circuits of FIGS. 6 and 8.

Until the car reaches the deceleration-initiating point, the deceleration-initiating point detector 10 in FIG. 1 is not actuated, and therefore the outputs of the reset signal generator circuit 12 for the latch circuit and the counter circuit are such that, as shown in (b) and (c) of FIG. 7, the reset signal for the counter circuit 15 is "1" ((c) of FIG. 7) and the reset signal of the latch circuit 17 is "0" ((b) of FIG. 7), thus holding the counter circuit and the latch circuit in reset conditions.

As a result, all the outputs of the counter circuit 15 are "0," all the outputs of the decoder circuit 16 are "1," all the outputs of the latch circuit 17 are "0," and all the outputs of the inverters with open collectors 18-1 to 18-6 are "1," thereby maintaining a high impedance.

When the contact 18-5 is closed by a car start signal, the series circuit including resistors 18-7 to 18-14 is connected to a DC power supply +E through the terminal 18-16. The voltage at the output terminal 18-17 accordingly takes the form of a stepped voltage with the maximum value thereof at the rise portion in (j) of FIG. 7 in accordance with voltage division by the resistors 18-7 to 18-13 and the resistor 18-14. This stepped voltage is the reference speed command for acceleration. The command voltages for both acceleration and deceleration are thus taken out from the same part, so that the command voltage at the end of acceleration may be easily rendered to coincide with that at the time of the start of deceleration. Consequently, the powering operation is smoothly switched to deceleration operation.

When the car reaches the deceleration-initiating point, the deceleration-initiating position detector is actuated. The reset signal generator circuit 12 in FIG. 1 operates in such a manner that, as shown in (b) and (c) of FIG. 7, the reset signal for the counter circuit 15 changes from "1" to "0," and the reset signal for the latch circuit 17 from "0" to "1," thereby setting both the counter circuit 15 and the latch circuit 17.

At the same time, the output of the inverter 18-1 with the open collector changes from "1" to "0" as shown in (d) in FIG. 7 and the resistor 18-7 is grounded, so that the voltage at the output terminal 18-17 drops as shown in (j) of FIG. 7.

The counter circuit 15 begins to count. When the pulses applied to the NAND element 16-1 reach a predetermined number, the output the NAND element changes from "1" to "0." Upon application of this output to the latch 17-1, the output of the latch 17-1 changes from "0"to "1" and is held at that value. In response to the output of the latch 17-1, the output of the inverter 18-2 with the open collector changes from "1" to "0" as shown in (e) of FIG. 7. The result is that the resistor 18-8 is grounded, thereby further reducing the voltage at the terminal 18-17.

Subsequently, the outputs of the NAND elements 16-2 to 16-5 are changed from "1" to "0," those of latches 17-2 to 17-5 from "0" to "1," and those of the inverters 18-3 to 18-6 with the open collector from "1" to "0" as shown in (f) to (i) of FIG. 7, thus grounding the resistors 18-9 to 18-12 sequentially. Accordingly, the voltage at the output terminal 18-17 is decreased stepwisely as shown in (j) of FIG. 7, which is the reference command voltage for deceleration. In other words, the reference speed command generator circuit 18 constitutes a digital-analog converter for converting the output of the decoder circuit 17 into an analog signal.

When the car decelerates and reaches the deceleration end position, the contact 18-15 is opened, thereby reducing the voltage at the output terminal 18-17 to zero.

In order to improve the reliability of the circuit of FIG. 6, it is desirable to take into consideration the matters mentioned below. A reference is made to the case where each of the inverters 18-1 to 18-6 of the reference speed command generator circuit 18, the decoder circuit 16 and the latch circuit 17 is comprises of not one integrated circuitry but two or more integrated circuits. Assume, for example, that the decoder circuit 16 is made up of two integrated circuits each including three NAND elements. It is happened that not only the individual NAND element is damaged but also the whole of the integrated circuit is damaged. If one of the integrated circuits includes the NAND elements 16-1 to 16-3 and the other integrated circuit the NAND elements 16-4 and 16-5, for instance, damage of the former integrated circuit would make three successive deceleration positions undetectable. Thus the reference speed command voltage for deceleration which is produced from the terminal 18-17 fails to decrease in the range from deceleration positions $S_1$ to $S_3$, but sharply drops at $S_4$. As a result, the riding comfort is degraded to a great extent and also the car stoppage position is displaced from the desired floor landing position. To overcome this problem, one of the integrated circuits includes NAND elements 16-1, 16-3 and 16-5 and the other integrated circuit NAND elements 16-2 and 16-4. Namely, the NAND elements in the integrated circuits are combined alternately. This configuration, even if one of the integrated circuits is damaged, prevents a sharp change in the speed command as mentioned above, and assures a bearable riding comfort and floor-landing accuracy, thus improving the reliability.

Such a countermeasure is preferably to be made for the latch circuit 17 and the inverters 18-1 to 18-6.

Figure 8:
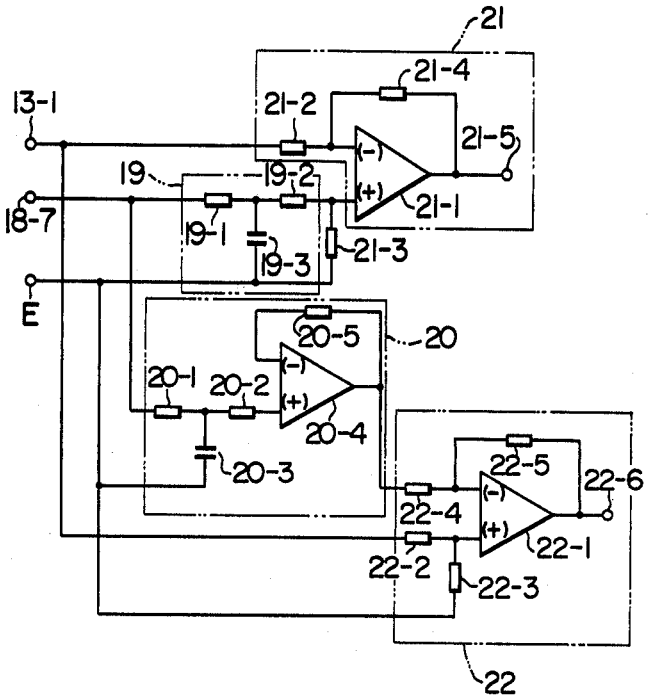
FIG. 8 shows the construction of a circuit for smoothing the reference speed command signal and detecting a speed difference.

Referring to the circuit diagram of FIG. 8, the reference speed command voltage produced by the circuit of FIG. 6 is applied to the acceleration command smoothing circuit 19 and the deceleration command smoothing circuit 20 thereby to produce a smoothly-increasing acceleration command and a smoothly-decreasing deceleration command. These commands are compared with the speed feedback voltage detected by the circuit of FIG. 2, thus detecting the speed deviation for acceleration control and that for deceleration control.

In FIG. 8, the stepped voltage of the reference speed command (the rise portion in (j) of FIG. 7) is applied to the terminal 18-17 in response to a car start signal. This stepped voltage is applied to the acceleration command smoothing circuit 19 including a primary delay circuit composed of resistors 19-1 and 19-2 and a capacitor 19-3. The circuit 19 thus produces a smoothly-increasing acceleration command voltage as shown in (k) of FIG. 7. This acceleration command voltage is applied to the positive terminal of an operation amplifier 21-1 of the acceleration command control comparator circuit 21. The negative terminal of the operation amplifier 21-1 is impressed with the speed feedback voltage delivered from the circuit of FIG. 2 through the terminal 13-1 and a resistor 21-2. The difference between the acceleration command voltage and the speed feedback voltage is produced at the output terminal 21-5 of the operation amplifier 21-1. During the powering cycle, the contact of the switching circuit 23 of FIG. 1 is closed on side b, and therefore the voltage difference corresponding to the speed deviation is applied to the phase shifter circuit 24 and the pulse amplifier circuit 25, so that thethyristors $SCR_1$ and $SCR_2$ are subjected to gate control for car powering control. In the process, the acceleration command voltage is appropriately determined by selecting the values of the resistors 19-1 and 19-2 and the capacitor 19-3 of attain car acceleration in a predetermined period of time. Reference numerals 21-3 and 21-4 show resistors.

The car deceleration command is produced from the deceleration command smoothing circuit 20. In other words, the reference speed command voltage (the rise portion in (j) of FIG. 7) is smoothed by a primary delay circuit composed of resistors 20-1 and 20-2 and a capacitor 20-3, and applied to the buffer amplifier including an operation amplifier 20-4 and a resistor 20-5. The resulting voltage is a deceleration command voltage smoothly decreasing, as shown in (l) of FIG. 7.

The deceleration command voltage thus obtained is applied through a resistor 22-4 to the negative terminal of an operation amplifier 22-1 of the deceleration control compartor circuit 22. The positive terminal of the operation amplifier 20-4 is impressed with the speed feedback command voltage delivered from the circuit of FIG. 2 through the terminal 13-2 and a resistor 22-1. Thus, the operation amplifier 22-1 produces at the terminal 22-6 the difference between the speed feedback voltage and the deceleration command voltage. During deceleration, the contact of the switching circuit 23 in FIG. 1 is closed on side c and therefore the voltage difference is applied to the phase shifter circuit 24. The phase shifter circuit 24 applies a gate signal corresponding to the above-mentioned voltage difference to the gates of the thyristors $SCR_1$ and $SCR_2$ through the pulse amplifier 25 for effecting deceleration control. Incidentally, reference numerals 22-3 and 22-5 show resistors.

It will be understood from the foregoing description that according to the present invention the car position and speed are easily detected by a single AC tachometer generation. This elminiates the need of separate device for speed and position detection respectively unlike the conventional elevator control system, resulting in a very low cost configuration. Further, an AC tachometer generator is less expensive than a DC tachometer generator and approximately one-third of the later in cost and requires no maintenance or inspection, thus leading to a higher economy and reliability. Furthermore, the car position is detected continually on the basis of the counting value of the counter circuit 15, so that it can be detected with high accuracy and at an optional point. This makes the apparatus according to the present invention applicable to any elevator system.

The above description is made mainly concerning with detection of the car position after initiation of car deceleration, in view of the fact that car position detection with high accuracy is especially required for generation of a deceleration command. Nevertheless, the present invention is of course applicable also to other methods with the same effect, for example, to a car position detecting method which is conventionally known and in which output pulses of a pulse generator are counted and the car position is detected over all the floors. In this case no special device for speed detection is required and the same effect as mentioned with reference to the above-mentioned embodiments is achieved.

What we claim is:

1. An elevator control apparatus including a motor for driving a car running in an elevator hoistway, a device for generating a speed command signal in accordance with the position of said car, and a device for controlling said motor in response to said speed command signal and a feedback signal of the speed of said motor; said elevator control apparatus further comprising an AC tachometer generator driven by said car drive motor, a rectifier circuit for rectifying the output of said AC tachometer generator to deliver said speed feedback signal, and a counter for detecting a car position by counting the number proportional to the output frequency of said AC tachometer generator.

2. An elevator control apparatus according to claim 1, further comprising a waveform-shaping circuit for shaping the waveform of the output of said AC tachometer generator and producing pulses whose number is proportional to the output frequency of said AC tachometer generator, said counter counting the output pulses produced from said wave-form-shaping circuit.

3. An elevator control apparatus according to claim 2, in which said waveform-shaping circuit generates one pulse for each cycle of the output of said AC tachometer generator.

4. An elevator control apparatus according to claim 1, in which said rectifier circuit comprises a full-wave rectifier bridge circuit including a plurality of diodes, and said counter counts a signal proportional to the output frequency of said AC tachometer generator taken out of one arm of said full-wave rectifier bridge circuit.

5. An elevator control apparatus according to claim 1, in which said AC tachometer generator is a three-phase AC tachometer generator and said rectifier is a three-phase full-wave rectifier bridge circuit for full-wave rectifying the output of said three-phase AC tachometer generator, and in which said apparatus further comprises a circuit for shaping a signal proportional to the output frequency of said three-phase AC tachometer generator taken out of one arm of said three-phase full-wave rectifier bridge circuit, into a pulse which is counted by said counter.

6. An elevator control apparatus according to claim 1, in which said speed command signal generator device generates a speed command signal on the basis of the counting value of said counter.

7. An elevator control apparatus according to claim 1, further comprising means for detecting that the car reaches a deceleration-initiating point, said counter being adapted to count the number proportional to the output frequency of said AC tachometer generator after said car has passed said deceleration-initiating point, and said speed command signal generator including means for generating a deceleration command signal on the basis of the counting value of said counter after said car has passed said deceleration-initiating point.

8. An elevator control apparatus according to claim 7, in which said deceleration command signal generating means includes a decoder for generating a signal at each time when the counter value of said counter reaches one of a plurality of predetermined settings, and a digital-analog converter for generating a deceleration command voltage sequentially decreasing at each time of generation of the output signal of said decoder.

9. An elevator control apparatus according to claim 8, in which the settings of said decoder are regulated in such a manner that said sequentially-decreasing deceleration command voltage has a constant deceleration rate.

10. An elevator control apparatus according to claim 8, in which said decoder comprises two integrated circuits each including associated ones of a plurality of elements corresponding to said plurality of settings respectively, said elements of said two integrated circuits being combined alternately with each other.

11. An elevator control apparatus according to claim 7, further comprising means for applying a count-prohibition signal to said counter before said car reaches the deceleration-initiating point, and means for cancelling the count prohibition after said car has passed said deceleration-initiating point.

12. An elevator control apparatus according to claim 7, further comprising means for detecting that said car has passed a deceleration end point, said deceleration command signal generator including means for converting said deceleration command signal into a zero speed command signal in response to the output of said deceleration end point passage detector means.

13. An elevator control apparatus according to claim 8, further comprising means for generating a car acceleration command voltage, the output voltage of said digital-analog converter at the time of deceleration start being made coincident with said acceleration command voltage at the time of acceleration end.

14. An elevator control apparatus according to claim 13, further comprising a switch for applying said acceleration command voltage to the output terminal of said digital-analog converter, and means for generating a reference speed command voltage continuously from car start to car stop at the output terminal of said digital-analog converter.

15. An elevator control apparatus according to claim 14, further comprising an acceleration command smoothing circuit for smoothing said reference speed command voltage, an acceleration control comparator circuit impressed with the output voltage of said acceleration command smoothing circuit and said speed feedback voltage and producing a difference therebetween, a deceleration command smoothing circuit for smoothing said reference speed command voltage, a deceleration control comparator circuit impressed with the output voltage of said deceleration command smoothing circuit and said speed feedback voltage and producing a difference therebetween, and a switching circuit for controlling said drive motor in response to the output of said acceleration control comparator circuit during car powering operation and for controlling said drive motor in response to the output of said deceleration control comparator circuit during car deceleration.

* * * * *